US010054296B2

(12) United States Patent
Chamberlain

(10) Patent No.: US 10,054,296 B2
(45) Date of Patent: Aug. 21, 2018

(54) HEAT DISSIPATING LED LIGHT BAR

(71) Applicant: LINMORE LED LABS, INC., Las Vegas, NV (US)

(72) Inventor: Paul Chamberlain, Las Vegas, NV (US)

(73) Assignee: LINMORE LED LABS, INC., Las Vegas, NV (US)

( * ) Notice: Subject to any disclaimer, the term of this patent is extended or adjusted under 35 U.S.C. 154(b) by 0 days.

(21) Appl. No.: 15/079,748

(22) Filed: Mar. 24, 2016

(65) Prior Publication Data

US 2016/0290571 A1 Oct. 6, 2016

Related U.S. Application Data

(60) Provisional application No. 62/140,267, filed on Mar. 30, 2015.

(51) Int. Cl.
*F21V 29/00* (2015.01)
*F21V 19/00* (2006.01)
(Continued)

(52) U.S. Cl.
CPC ..... *F21V 19/004* (2013.01); *F21S 4/28* (2016.01); *F21V 19/0045* (2013.01);
(Continued)

(58) Field of Classification Search
CPC ..... F21V 29/74; F21V 29/83; F21V 19/004; F21V 19/0045; F21V 29/745;
(Continued)

(56) References Cited

U.S. PATENT DOCUMENTS 7,520,640 B1 * 4/2009 Shuai ..... F21S 8/033 362/240
7,535,030 B2 * 5/2009 Lin ..... F21K 9/27 257/99

(Continued)

OTHER PUBLICATIONS

RedBird LED "Stripit Kit." 3 pages. www.redbirdled.com.
RedBird LED "Stripit Kit Specification Sheet." 2 pages. www.redbirdled.com.

*Primary Examiner* — Paultep Savusdiphol
(74) *Attorney, Agent, or Firm* — Stetina Brunda Garred and Brucker; Mark B. Garred

(57) ABSTRACT

A heat dissipating LED light bar which may be used as part of a complete retrofit system for a variety of linear fluorescent light fixtures. The LED light bar comprises an elongate channel member which is preferably fabricated from extruded aluminum. In addition to the channel member, the LED light bar comprises a high-efficacy set of LEDs, which are preferably provided in the form of an elongate LED printed circuit board (PCB) or strip mechanically bonded to the channel member. The channel member is outfitted with fins and other surface features uniquely configured to provide superior heat dissipation, thus allowing the channel member to effectively function as a heat sink for the LED strip cooperatively engaged thereto. Further, the channel member is configured to define an air flow cavity under the LED strip as allows for the effective dissipation of heat during operation of the LED light bar.

20 Claims, 6 Drawing Sheets

(51) Int. Cl.

| | |
|---|---|
| ***F21V 29/74*** | (2015.01) |
| ***F21V 29/83*** | (2015.01) |
| ***F21S 4/28*** | (2016.01) |
| *F21Y 105/10* | (2016.01) |
| *F21Y 115/10* | (2016.01) |

(52) U.S. Cl.
CPC ..... *F21V 29/74* (2015.01); *F21V 29/83* (2015.01); *F21Y 2105/10* (2016.08); *F21Y 2115/10* (2016.08)

(58) Field of Classification Search
CPC ..... F21V 29/76; F21V 29/77; F21Y 2105/10; F21Y 2115/10
USPC ..... 362/218, 223, 217.1, 217.14, 294, 373
See application file for complete search history.

(56) References Cited

U.S. PATENT DOCUMENTS 7,753,568 B2 * 7/2010 Hu ..... F21K 9/00 362/294
8,066,414 B2 * 11/2011 Pabst ..... F21V 29/2212 362/249.02
8,297,788 B2 10/2012 Bishop
8,960,951 B1 * 2/2015 Rao ..... F21K 9/17 362/217.14
9,316,805 B2 * 4/2016 Howe ..... G02B 7/006
9,488,351 B1 * 11/2016 Szeto ..... F21V 29/00
2008/0290350 A1 * 11/2008 Lin ..... F21K 9/27 257/88
2009/0071624 A1 * 3/2009 Zhang ..... F21K 9/00 165/80.3
2009/0219713 A1 * 9/2009 Siemiet ..... F21V 3/02 362/218
2009/0290334 A1 * 11/2009 Ivey ..... F21V 23/06 362/219
2010/0220469 A1 * 9/2010 Ivey ..... F21K 9/27 362/218
2011/0199005 A1 * 8/2011 Bretschneider ..... F21V 7/22 315/152
2012/0044666 A1 * 2/2012 Buelow ..... H05B 33/0803 362/85
2013/0044476 A1 * 2/2013 Bretschneider ..... F21V 29/70 362/235
2013/0170197 A1 7/2013 Bishop
2014/0119000 A1 5/2014 Zhang et al.
2015/0003053 A1 * 1/2015 Ariyoshi ..... F21K 9/17 362/223

* cited by examiner

HEAT DISSIPATING LED LIGHT BAR

CROSS-REFERENCE TO RELATED APPLICATIONS

The present application claims priority to U.S. Provisional Application Ser. No. 62/140,267 entitled HEAT DISSIPATING LIGHT BAR filed Mar. 30, 2015.

STATEMENT RE: FEDERALLY SPONSORED RESEARCH/DEVELOPMENT

Not Applicable

BACKGROUND OF THE INVENTION

1. Field of the Invention

The present disclosure relates generally to lighting systems and, more particularly, to an LED light bar which is uniquely configured to provide superior heat dissipation characteristics, and is further adapted for retrofit applications in substitution for any one of a variety of linear fluorescent light fixtures.

2. Description of the Related Art

The use of LED (Light Emitting Diode) lights is becoming increasingly popular in a wide variety of lighting applications. Significant advances have been made in LED lighting technology, which has made the use of LED lights more affordable and desirable in various industrial, household, and other environments requiring expanded lighting systems.

LED lights are generally viewed as offering significant advantages over traditional incandescent lighting systems. With incandescent bulbs, the expense is not only the cost of replacement bulbs, but the labor and costs associated with frequent replacement of the bulbs. This expense can be significant where there are a large number of installed bulbs. For example, the high maintenance costs typically incurred to replace bulbs in large office buildings, commercial warehouses, and the like are substantially minimized with LED lighting systems. In addition, the operational life of conventional white LED lamps is about 100,000 hours, which is a drastic increase over the average life of an incandescent bulb, which is approximately 5000 hours. Thus, the use of LED lights virtually eliminates the need for routine bulb replacement, this advantage being even more important when the lighting device is embedded or located in a relatively inaccessible place. Still further, it is generally recognized that, in a properly designed system, LED lights consume significantly less power than incandescent bulbs. In greater detail, an LED circuit has an efficiency of about 80%, meaning that about 80% of the electrical energy is converted to light energy, while the remaining 20% is lost as heat energy. As will be recognized, this efficiency facilitates significant cost savings in large lighting systems.

However, due in part to the relatively high cost of LED lights, the art turned to fluorescent light bulbs and systems as an alternative to incandescent lights. Generally speaking, fluorescent lighting is significantly less costly than incandescent lighting while providing essentially the same brightness, and also lasts longer than conventional incandescent lighting. In greater detail, on average, a fluorescent tube has a lifespan of about six times longer than a regular incandescent bulb. Because of these advantages, a vast majority of commercial and industrial structures incorporate conventional fluorescent light baring fixtures.

Fluorescent lights, however, have distinct disadvantages which detract from their overall utility. In greater detail, fluorescent lighting circuits are more complex than incandescent lighting and generally require professional installation and expensive components. In addition, fluorescent lighting is generally less attractive than incandescent lighting and can flicker noticeably, while also producing an uneven light. Mercury is also an essential component in the manufacturing of fluorescent light tubes, and is considered hazardous by the U.S. Environmental Protection Agency due to its ability to bio-accumulate within the environment. Along these lines, the disposal of fluorescent light tubes is problematic for many municipalities.

The aforementioned drawbacks associated with the use fluorescent lighting have resulted in an increased reliance on LED lighting, with the use LED light bars as an alternative to fluorescent light tubes becoming more prevalent as the costs of LED lighting continue to decrease in the marketplace. However, the cost of replacing existing fluorescent light tube fixtures and circuitry in existing structures, systems, and so forth, is still relatively high. These costs are sometimes escalated by the designs of known LED lighting bars not being well suited for quick and easy retrofit installation, and further not being adapted for optimal heat dissipation which may result in the need to provide ancillary modalities to facilitate adequate heat dissipation. Thus, there is thus a need for an LED lighting system including an LED light bar that can easily and affordably be used in retrofit applications in substitution for conventional fluorescent light fixtures, and is provided with superior heat dissipation structural features. These, as well as other features and advantages are provided by the present disclosure as will be described in more detail below.

BRIEF SUMMARY OF THE INVENTION

In accordance with the present disclosure, there is provided a heat dissipating LED light bar which may be used as part of a complete retrofit system for a variety of linear fluorescent light fixtures. It is contemplated that the LED light bar of the present disclosure may be provided in one of several nominal lengths (e.g., about 21 inches and about 45 inches) to retrofit the most popularly installed fluorescent light fixtures. The LED light bar comprises, among other things, an elongate channel member which is preferably fabricated from extruded aluminum (e.g., 6063 T5 aluminum). In addition to the channel member, the LED light bar comprises a high-efficacy set of LEDs, which are preferably provided in the form of an elongate LED printed circuit board (PCB) or strip. In greater detail, the LED strip preferably comprises an aluminum core which is mechanically bonded to the channel member, and has a multiplicity of LEDs (e.g., from 144 to 288) disposed thereon in a prescribed pattern or arrangement (e.g., two side-by-side rows).

The LED light bar further comprises an integral volumetric diffuser which is coupled to the channel member and effectively covers or shields the LED strip. The volumetric diffuser is adapted to eliminate glare and evenly distribute light, transmitting about 95% of the generated lumens from the LED strip, with the beam angle generated by the LED light bar being about 180° for a wide distribution of light. The LED light bar is further glass free based on the preferred material for the diffuser. The LED light bar further preferably comprises an external dimmable driver which electrically communicates with the LED strip.

The channel member of the LED light bar is outfitted with fins and other surface features uniquely configured to provide superior heat dissipation, thus allowing the channel member to effectively function as a heat sink for the LED strip cooperatively engaged thereto. Along these lines, the channel member is configured to provide or define an air flow cavity under the LED strip as allows for the effective dissipation of heat during operation of the LED light bar. The preferred mechanical bonding of the interior LED strip to the channel member maximizes the efficacy or functionality of the channel member as a heat sink. The LED light bar is further preferably outfitted with an identically pair of end caps which are cooperatively engaged to respective ones of the opposed ends of the channel member. The end caps are configured to provide open fluid communication between the air flow cavity and ambient air, and are further each outfitted with suitable modalities to facilitate the retrofit attachment of the LED light bar to an underlying support surface.

The present disclosure is best understood by reference to the following detailed description when read in conjunction with the accompanying drawings.

BRIEF DESCRIPTION OF THE DRAWINGS

These, as well as other features of the present disclosure, will become more apparent upon reference to the drawings wherein.

Common reference numerals are used throughout the drawings and detailed description to indicate like elements.

DETAILED DESCRIPTION OF THE INVENTION

Figure 1:
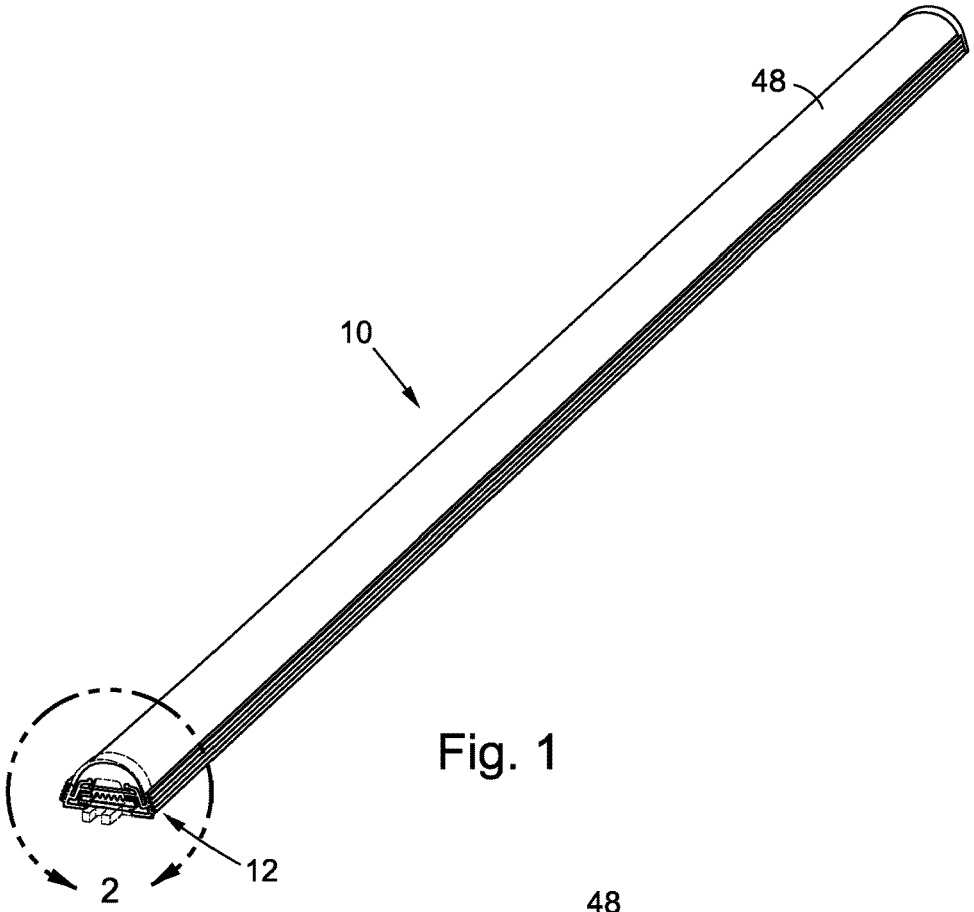
FIG. 1 is a top perspective view of an LED light bar constructed in accordance with the present disclosure.
Figure 2:
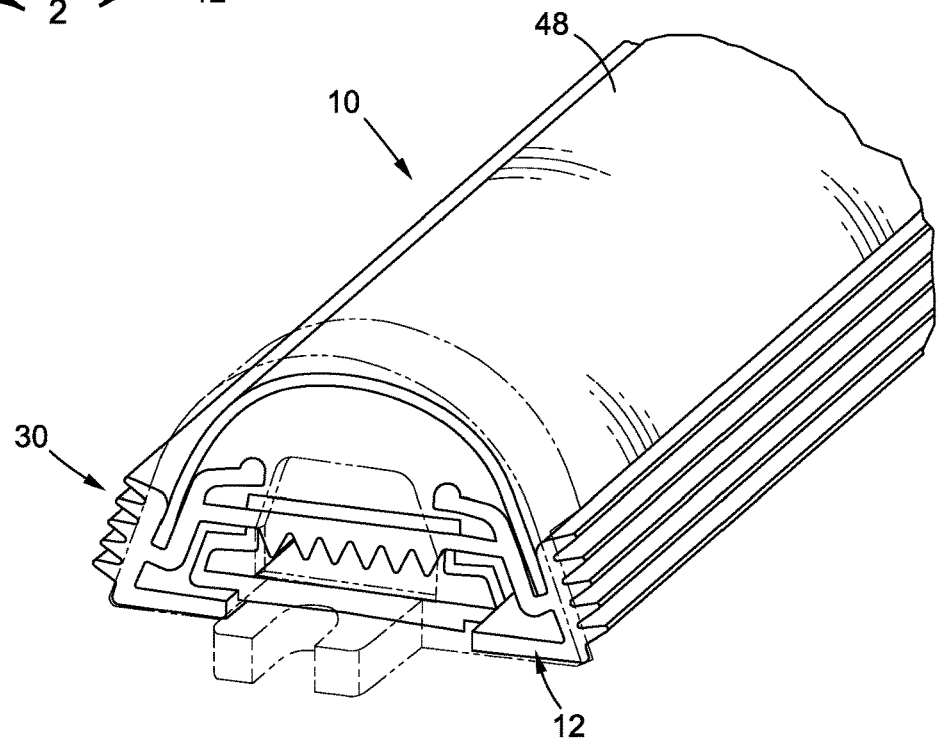
FIG. 2 is an enlargement of the encircled region 2 shown in FIG. 1.
Figure 3:
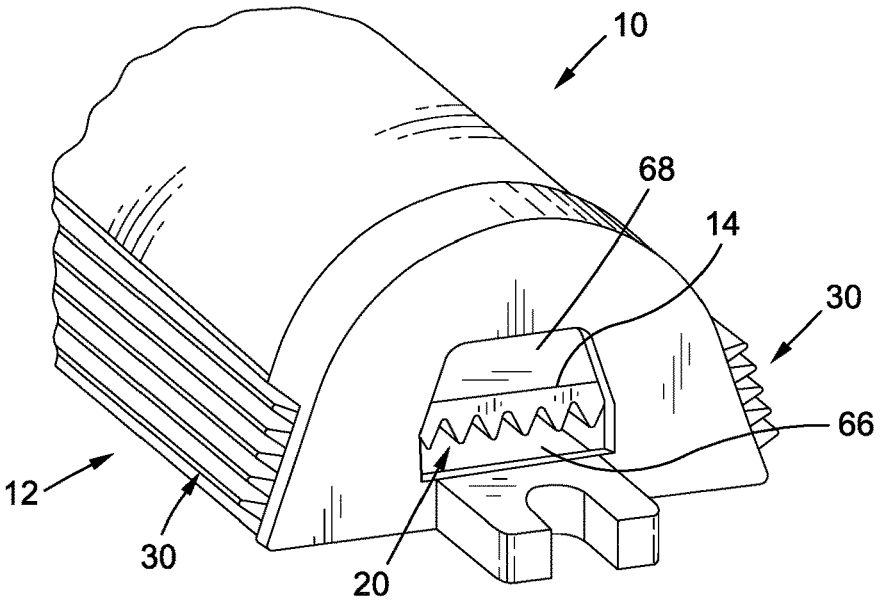
FIG. 3 is a further an enlargement of one end portion of the LED light bar of the present disclosure shown in FIG. 1, but depicting one of the end caps of the opposed pair included therein in greater detail.
Figure 4:
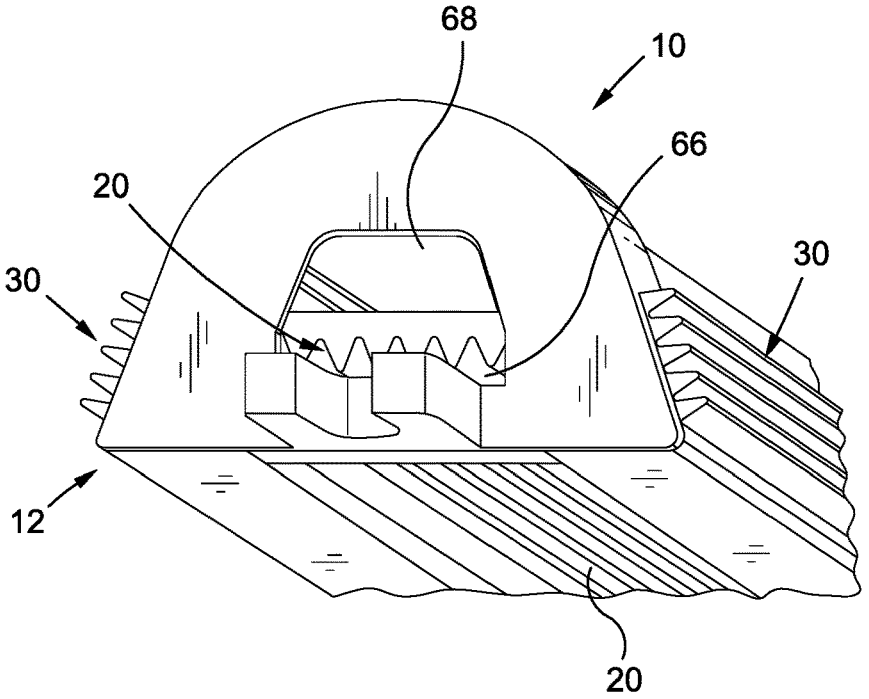
FIG. 4 is a bottom perspective view of the LED light bar tube shown in FIG. 3.

Referring now to the drawings for which the showings are for purposes of illustrating a preferred embodiment of the present disclosure only, and not for purposes of limiting the same, FIGS. 1-6 depict an LED light bar 10 constructed in accordance with the present disclosure. As indicated above, the LED light bar 10 may be used as part of a complete retrofit system for a variety of linear fluorescent light fixtures. In an exemplary embodiment of the present disclosure, the LED light bar 10 may be provided in one of several nominal lengths, e.g., about 21 inches and about 45 inches, to retrofit the most popularly installed fluorescent light fixtures. However, those of ordinary skill in the art will recognize that these length dimensions are exemplary only, and may be selectively increased or decreased without departing from the spirit and scope of the present disclosure.

Figure 7:
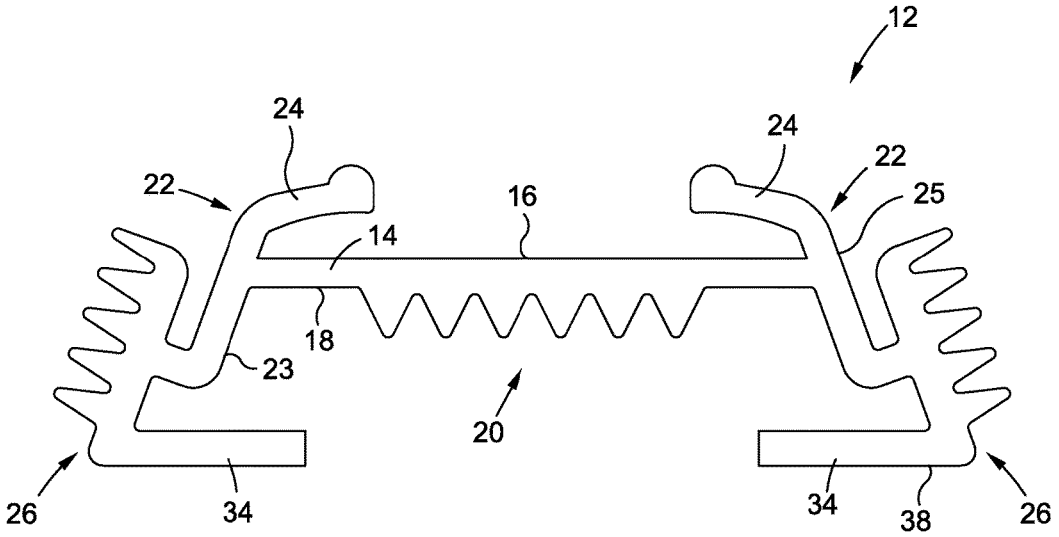
FIG. 7 is a cross-sectional view of the channel member of the LED light bar of the present disclosure, as labeled with various preferred dimensional parameters.
Figure 8:
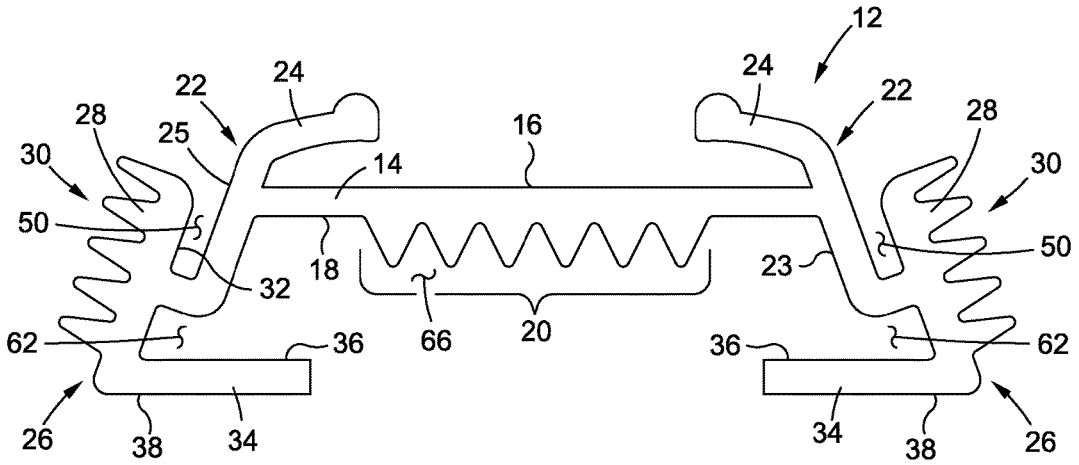
FIG. 8 is a cross-sectional view of the channel member of the LED light bar of the present disclosure similar to FIG. 7, but omitting the dimensional parameters.
Figure 9:
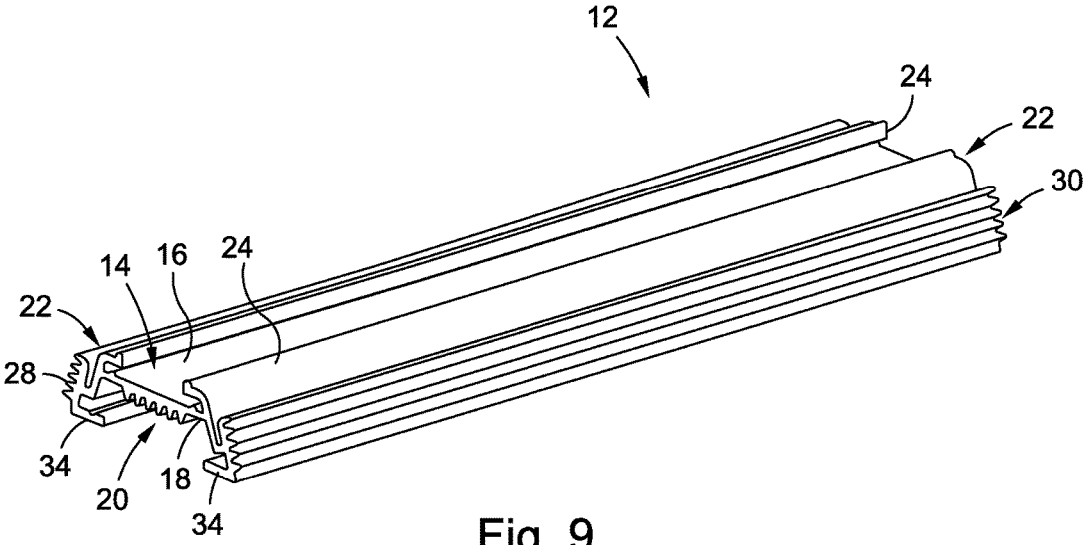
FIG. 9 is a top perspective view of the channel member of the LED light bar of the present disclosure.

One of the primary structural features of the LED light bar 10 is an elongate channel member 12, shown with particularity in FIGS. 7-9. The channel member 12 is preferably fabricated from extruded aluminum (e.g., 6063 T5 aluminum), though other materials may be used for the fabrication of the channel member 12 without departing from the spirit and scope of the present disclosure. In greater detail, the channel member 12 comprises an elongate support portion 14 which defines opposed longitudinal sides and, from the perspective shown in FIGS. 7 and 8, a generally planar first, top surface 16. In addition to the first surface 16, the support portion 14 defines a second, bottom surface 18 which extends in generally opposed relation to the first surface 16. As is most easily seen in FIGS. 7-9, the second surface 18, in contrast to the first surface 16, does not have a generally planar configuration. Rather, a central region 20 of the second surface 18 has a serrated configuration, defining a multiplicity of protrusions which each have a generally triangular or wedge-shaped cross-sectional profile. As will be recognized by those of ordinary skill in the art, due to the inclusion of the serrated central region 20 therein, the surface area defined by the second surface 18 substantially exceeds that defined by the opposed first surface 16 in the support portion 14 of the channel member 12.

In addition to the support portion 14, the channel member 12 includes an identically configured pair along of elongate flange portions 22 which are integrally connected to and extend along respective ones of the longitudinal sides of the support portion 14 in opposed relation to each other. As further seen in FIG. 8, each of the flange portions 22 defines an elongate coupling arm segment 24 which is angularly offset relative to the remainder thereof so as to overlap or overhang a portion of the first surface of the support portion 14. The remainder of each flange portion 22 not defined by the coupling arm segment 24 extends angularly relative to the support portion 14, and defines both an interior surface 23 and an opposed exterior surface 25. The opposed longitudinal sides of the support portion 14 extend to respective ones of the interior surfaces 23. From the perspective shown in FIGS. 7 and 8, that segment of each flange portion 22 which is not defined by the coupling arm segment 24 and extends below the support portion 14 is outwardly flared relative to the second surface 18. The use of the coupling arm segments 24 as defined by the flange portions 22 will be discussed in more detail below.

In addition to the support and flange portions 14, 22, the channel member 12 further comprises an identically configured pair of elongate rail portions 26 which are integrally connected to and extend along respective ones of the flange portions 22 in opposed relation to each other. As also seen in FIG. 8, each of the rail portions 26 defines a heat sink arm segment 28 having an exteriorly presented serrated surface 30 defining a multiplicity of protrusions which also each have a generally triangular or wedge-shaped cross-sectional profile. In addition to the exterior serrated surface 30, each heat sink arm segment 28 defines an opposed interior surface 32. In the channel member 12, each flange portion 22 transitions to the interior surface 32 of the heat sink arm segment 28 of a corresponding one of the rail portions 26. Similar to the support portion 14, the surface area defined by the exterior serrated surface 30 of each heat sink arm segment 28 substantially exceeds that of the opposed interior surface 32 thereof. In addition to the heat sink arm segment 28, each rail portion 26 defines a base arm segment 34 which is integrally connected and extends at a generally acute angle relative to the corresponding heat sink arm segment 28. Each base arm segment 34 defines a generally planar interior surface 36 which is directed toward or faces the second surface 18 of the support portion 14, and an opposed exterior surface 38 which also has a generally planar configuration.

Figure 5:
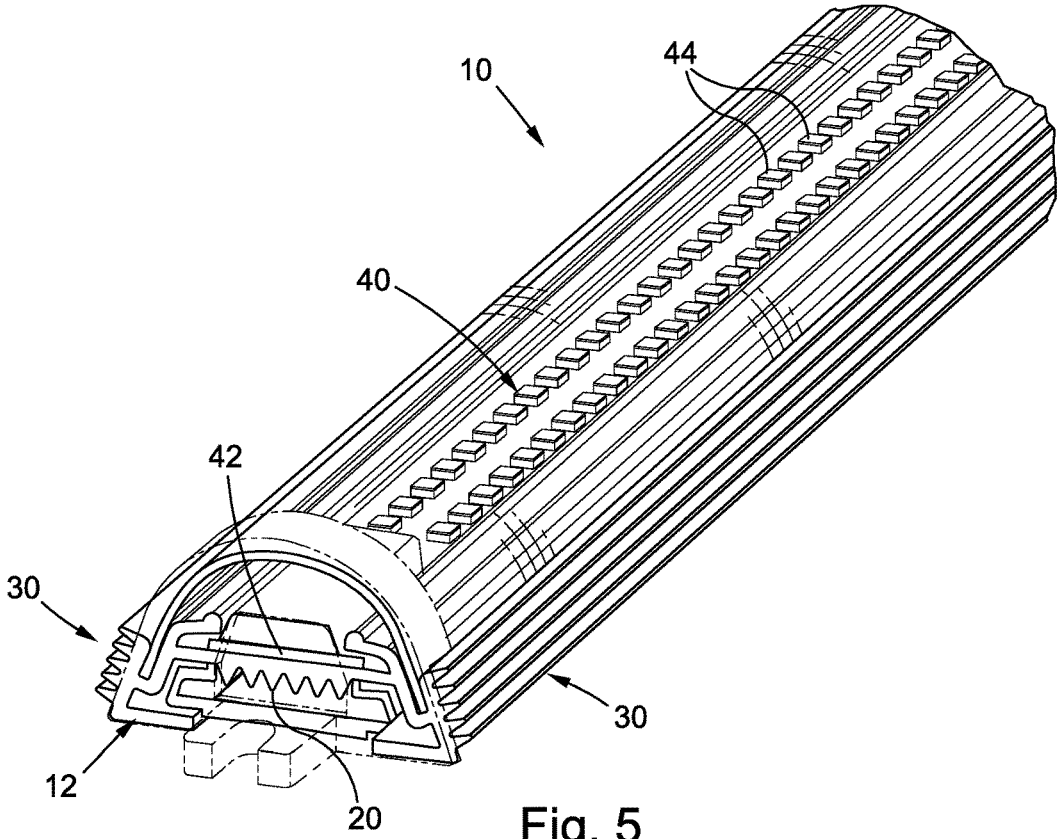
FIG. 5 is a top perspective view of the LED light bar of the present disclosure similar to FIG. 1, but with the diffuser removed for purposes of depicting the LED strip thereof.
Figure 6:
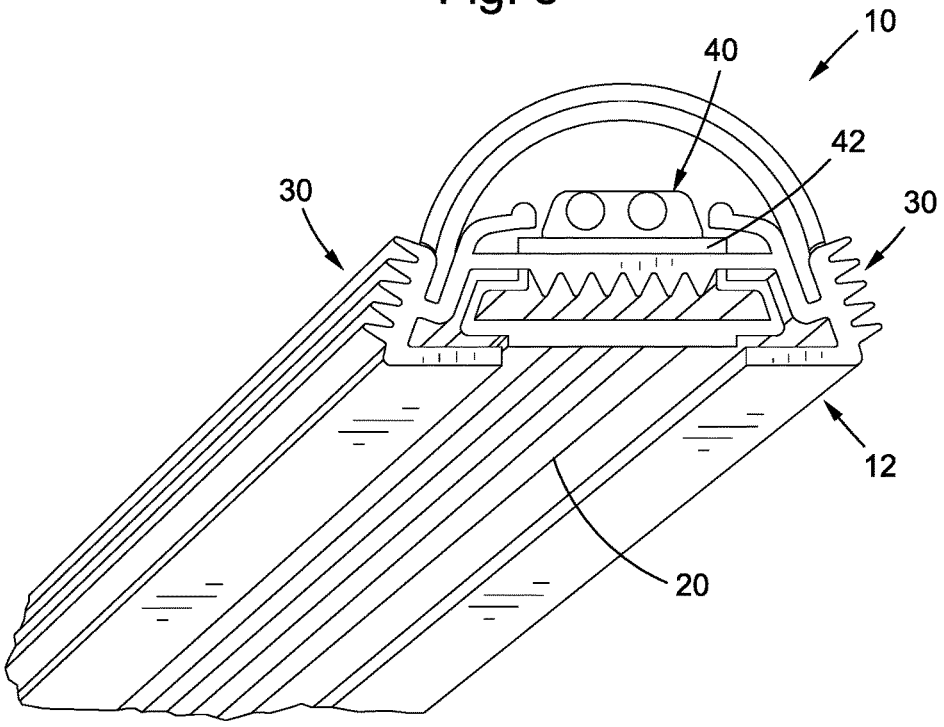
FIG. 6 is a is a bottom perspective view of the LED light bar of the present disclosure similar to FIG. 1, but with one of the end caps removed for purposes of depicting the LED strip thereof.

The LED light bar 10 further comprises an elongate LED strip 40 which is most easily seen in FIGS. 5 and 6. In the LED light bar 10, the LED strip 40 preferably comprises an elongate core 42 which has a strip-like configuration and, from the perspective shown in FIGS. 5 and 6, defines opposed, generally planar top and bottom surfaces. The core 42 is preferably fabricated from aluminum, though alternative materials may be used without departing from the spirit and scope of the present disclosure. Disposed on the top surface of the core 42 is a multiplicity of LEDs 44. The LEDs 44 are disposed on the top surface of the core 42 in a prescribed pattern or arrangement which, as shown in FIG. 5, comprises two side-by-side, generally parallel rows thereof. In an LED light bar 10 having a nominal length of about 21 inches, it is contemplated that the LED strip 40 thereof will be outfitted with about 144 LEDs 44. In an LED light bar 10 having a nominal length of about 45 inches it is contemplated that the LED strip 40 thereof will be outfitted with about 288 LEDs 44. However, those of ordinary skill in the art will recognize that the number and arrangement of LEDs 44 disposed on the top surface of the core 42 in the LED strip 40 integrated into the LED light bar 10 may also be varied from that described above without departing from the spirit and scope of the present disclosure.

In the LED light bar 10, it is contemplated that the LED strip 40, and in particular the core 42 thereof, will be mechanically bonded to the first surface 16 of the support portion 14 of the channel member 12. In greater detail, subsequent to the placement of the LED strip 40 upon the support portion 14 and extension of the LED strip 40 the first surface 16 thereof, each of the coupling arm segments 24 of the flange portions 22 included in the channel member 12 will be bent slightly downwardly from the relative orientations shown in FIG. 8 so as to mechanically abut or engage the LED strip 40. In greater detail, the size and position of the LED strip 40 relative to the size and position of the coupling arm segments 24 results in the bent coupling arm segments 24 engaging corresponding portions of the top surface of the core 42 which extend along respective ones of the opposed longitudinally extending sides or edges thereof in the manner shown in FIG. 6. Thus, by virtue of the abutment of the coupling arm segments 24 of the flange portions 22 against the core 42, the LED strip 40 is effectively mechanically captured between the coupling arm segments 24 and the first surface 16 of the support portion 14. It is contemplated that the length of the LED strip 40, and in particular the core 42 thereof, will be substantially equal to that of the channel member 12, thus resulting in the opposed lateral ends of the core 42 terminating in a substantially flush or continuous relationship with respective ones of the opposed lateral ends of the support portion 14, and in particular the first surface 16 thereof (and hence respective ones of the opposed lateral ends of the channel member). When the LED strip 40 is cooperatively engaged to the support portion 14 of the channel member 12 in the aforementioned manner, the core 42 and LEDs 44 disposed thereon are in substantial alignment or registry with the serrated central portion 20 of the second surface 18 of the support portion 14.

Figure 10:
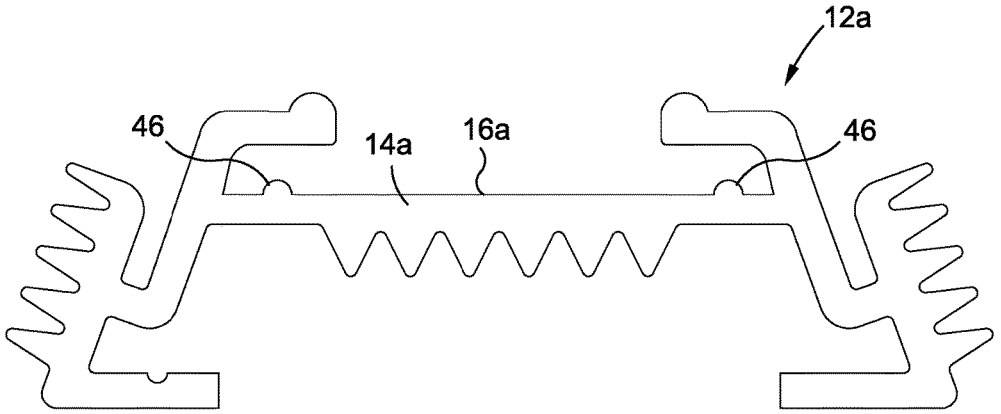
FIG. 10 is a cross-sectional view of alternative channel member which may be integrated into the LED light bar of the present disclosure as a minor structural variant of the channel member shown in FIGS. 7 and 8.

Referring now to FIG. 10, there is shown a channel member 12*a* which comprises a slight structural variant of the channel member 12, and may be integrated into the LED light bar 10 in substitution for the channel member 12. In greater detail, the sole distinction between the channel members 12, 12*a* lies in the support portion 14*a* of the channel member 12*a* being provided with an identically configured pair of elongate alignment ribs 46 formed on and extending longitudinally along the first surface 16*a* of the support portion 14*a* in spaced, generally parallel relation to each other. In the channel member 12*a*, the alignment ribs 46 are operative to maintain the LED strip 40 in a prescribed position on the first surface 14*a*, thus assisting in the prevention of any undesirable movement or shifting of the LED strip 40 during the process of bending the coupling arm segments 24 of the flange portions 22 to effectively engage the same.

The LED light bar 10 further comprises an integral volumetric diffuser 48 which is coupled to the channel member 12 and effectively covers or shields the LED strip 40. As seen in FIGS. 2-4 and 6, the diffuser 48 has an arcuate, arch-like configuration, and is sized to span the length of the channel member 12, with the opposed lateral ends of the diffuser 48 terminating in a substantially flush or continuous relationship with respective ones of the opposed lateral ends of the channel member 12. The cooperative engagement of the diffuser 48 to the channel member 12 is preferably facilitated by the advancement of the opposed longitudinally extending edge portions of the diffuser 48 into respective ones of a complementary pair of recesses 50 defined by the channel member 12.

As is best seen in FIG. 8, each recess 50 of the channel member 12 is collectively defined by the exterior surface 25 of a corresponding flange portion 22, and an opposed segment of the interior surface 32 of the heat sink arm segment 28 of the corresponding rail portion 26. The diffuser 48 is frictionally retained within the recesses 50. Such frictional retention may be attributable, in part, to an outward biasing force exerted by the diffuser 48 against the channel member 12, the diffuser 48 preferably having some measure of resiliency as allows the opposed longitudinally extending edge portions thereof to be slightly flexed toward each other as allows for their advancement into respective ones of the recesses 50. An exemplary diffuser 48 integrated into the LED light bar 10 is adapted to eliminate glare and evenly distribute light, transmitting about 95% of the generated lumens from the LED strip 40. In addition, the diffuser 48 is preferably configured such that the beam angle generated by the LED light bar 10 is about 180° for wide distribution of light.

Figure 11:
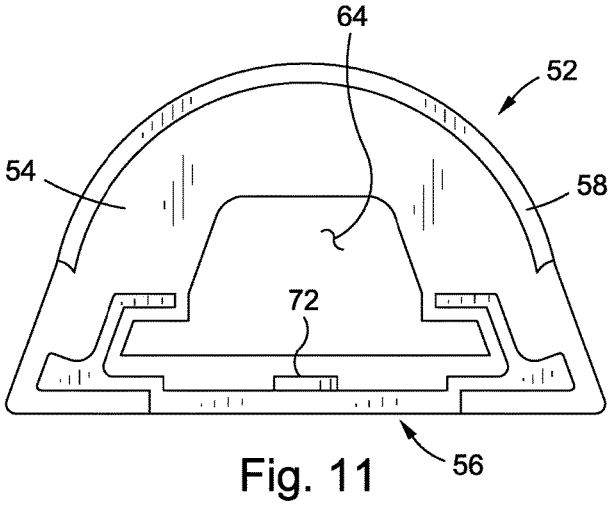
FIG. 11 is a front elevational view of one of the identically configured pair of end caps integrated into the LED light bar of the present disclosure.
Figure 12:
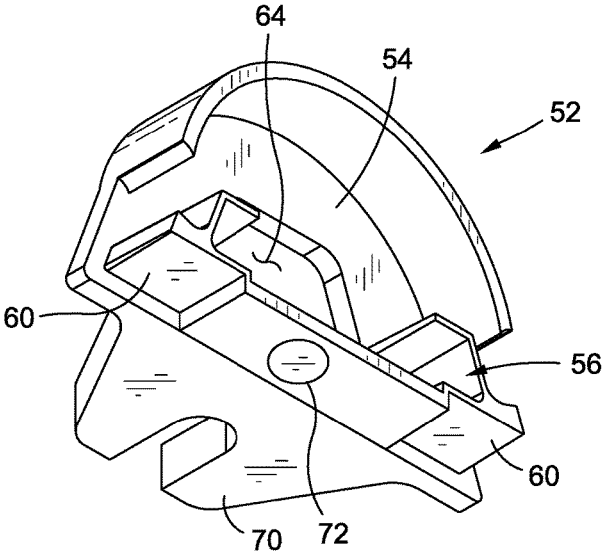
FIG. 12 is a bottom perspective view of the end cap shown in FIG. 11.
Figure 13:
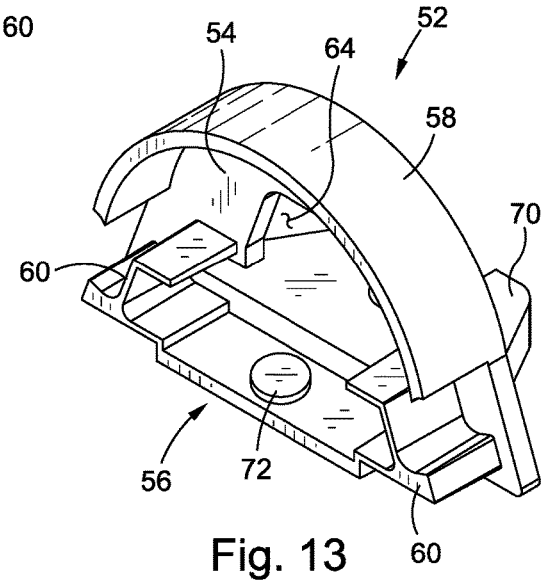
FIG. 13 is a top perspective view of the end cap shown in FIG. 11.

Referring now to FIGS. 11-13, the LED light bar 10 of the present invention further comprises an identically configured pairs of end caps 52 which are cooperatively engaged to respective ones of the opposed lateral ends of the channel member 12. Generally speaking, each of the end caps 52 comprises an end wall portion 54 having a base portion 56 integrally formed on and extending along one peripheral side segment thereof, and an arcuate flange portion 58 integrally formed on and extending along another peripheral side segment thereof in generally opposed relation to the base portion 56. As seen in FIGS. 12 and 13, that segment of the base portion 56 protruding from the end wall portion 54 in the same direction as the flange portion 58 defines an opposed, identically configured pair of engagement tabs 60.

In the LED light bar 10, the engagement tabs 60 of each end cap 52 are sized and configured to be advanced into and frictionally maintained within respective ones of an opposed pair of recesses 62 which are also defined by the channel member 12. As seen in FIG. 8, each recess 62 is collectively defined by the interior surface 36 of the base arm segment 34 of a corresponding rail portion 26, a segment of the interior surface 32 of the heat sink arm segment 28 of that same rail portion 26, and a segment of the interior surface 23 of the corresponding flange portion 22. The advancement of the engagement tabs 60 into the complimentary recesses 62 is limited by the abutment of the corresponding lateral end of the channel member 12 against the end wall portion 54 of the corresponding end cap 52. As the advancement of the engagement tabs 60 of each end cap 52 into the recesses 62 occurs, the arcuate flange portion 58 of such end cap 52 is simultaneously advanced over a corresponding lateral end portion of the diffuser 48 which is preferably engaged to the channel member 12 prior to the attachment of the end caps 52 to each of the opposed ends thereof.

Each end cap 52 further defines an opening 64 within the end wall portion 54 thereof. When the end caps 52 are cooperatively engaged to the channel member 12, each opening 64 is aligned and fluidly communicates with an air flow cavity 66 of the channel member 12 which spans the length thereof, and is collectively defined by the second surface 18 of the support portion 14 (including the serrated central portion 20 of the second surface 18), the interior surfaces 23 of the flange portions 22, those segments of the interior surfaces 32 of the heat sink arm segments 28 of the rail portions 26 which do not partially define the recesses 50, and the interior surfaces 36 (as well as the inner ends) of the base arm segments 34 of the rail portions 26. Each opening 64 is further aligned and fluidly communicates with a cavity 68 of the LED light bar 10 which is collectively defined by portions of the channel member 12, and both the LED strip 40 and diffuser 48 attached to the channel member 12.

In addition to the engagement tabs 60, the base portion 56 of each end cap 52 defines a mounting tab 70 which protrudes from the end wall portion 54 in generally opposed relation to the engagement tabs 60, i.e., in a direction generally opposite the direction both the engagement tabs 60 and flange portion 58 protrude from the end wall portion 54. The mounting tabs 70 of the end caps 52 are uniquely configured to facilitate the retrofit attachment of the LED light bar 10 to an underlying support surface, such as a ceiling structure. In this regard, as best seen in FIGS. 12 and 13, each of the mounting tabs 70 defines a central recess which is adapted to accommodate a suitable fastener, such as a screw. It is also contemplated that the base portion 56 of each end cap 52 may optionally have a magnet 72 disposed therein. If included in each end cap 52, the magnets 72 assist in the installation of the LED light bar 10 by maintaining it in firm engagement to an underlying metallic surface prior to the advancement of fasteners through the mounting tabs 70.

When the LED light bar 10 is attached to an underlying support surface through the use of the mounting tabs 70 (alone or in combination with the magnets 72) of the end caps 52 thereof, it is contemplated that the exterior surfaces 38 of the base arm segments 34 will be abutted against such support surface. As such, with the LED light bar 10 being mounted to such support surface, the air flow cavity 66 is partially enclosed or bounded by the support surface itself which spans across the gap defined between the inner ends of the base arm segments 34.

During operation of the LED light bar 10, the heat generated by the activation of the LEDs 44 is effectively transferred to the core 42 of the LED strip 40. As a result of its direct contact with the first surface 16 of the support portion 14, the core 42 (which is also fabricated from aluminum as indicated above) in turn transfers the heat to the support portion 14 of the channel number 12. Heat transferred from the core 42 to the support portion 14 is in turn effectively dissipated into air within the air flow cavity 66, the heat transfer from the support portion 14 to the air flow cavity 66 being enhanced by the inclusion of the serrated central portion 20 of the second surface 18 which allows the support portion 14 to more effectively function as a heat sink. Heat transferred to the support portion 14 from the core 42 is further transferred to the rail portions 26 via respective ones of the intervening flange portions 22 which, as indicated above, are integrally connected to both the support portion 14 and the rail portions 26. Heat transferred to the rail portions 26 is effectively dissipated to ambient air by the serrated surfaces 30 of the heat sink arm segments 28. Thus, the support portion 14 (attributable to its inclusion of the serrated surface 30) and the rail portions 26 (attributable to their inclusion of the serrated surfaces 30 on the heat sink arm segments thereof) effectively define three (3) separate heat sinks within the channel member 12 which allow for the efficient, effective dissipation of heat generated by the LEDs 44 of the LED strip 40. Heat is further dissipated into the open air within the aforementioned cavity 68, further enhancing the efficacy of the LED light bar 10 in dissipating heat. Along these lines, natural air circulation through the air flow cavity 66 and the cavity 68 as afforded by the openings 64 within the end caps 52 assists in the dissipation of heat from the LED light bar 10.

This disclosure provides exemplary embodiments of the present disclosure. The scope of the present disclosure is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. An LED light bar, comprising:

an elongate channel member defining:

an elongate support portion which defines a first surface and an opposed second surface, at least a portion of the second surface having a serrated configuration of increased surface area;

an identically configured pair of elongate flange portions integrally connected to and extending along the support portion in opposed relation to each other, each of the flange portions defining a coupling arm segment which at least partially overhangs the first surface of the support portion; and an identically configured pair of elongate rail portions integrally connected to and extending along respective ones of the flange portions in opposed relation to the each other, each of the rail portions defining a heat sink arm segment having an exteriorly presented serrated surface and base arm segment which may be abutted against an underlying support surface;

an LED strip attached to the channel member and extending along at least portion of the first surface of support portion thereof, the LED strip being maintained in engagement to the support portion by the coupling arm segments of the flange portions; and a diffuser cooperatively engaged to the channel member in a manner effectively covering the LED strip;

wherein the channel member is shaped such that the second surface of the support portion is separated from the base arm segments of the rail portions by a distance sufficient to facilitate the formation of a heat dissipating air flow cavity between the second surface and the support surface when the base arm segments are abutted against the support surface.

2. The LED light bar of claim 1 further comprising an identically configured pair of elongate alignment ribs formed on and extending along the first surface of the support portion in spaced, generally parallel relation to each other, the alignment ribs being operative to assist in maintaining the LED strip in a prescribed position on the first surface of the support portion.

3. The LED light bar of claim 1 further comprising an identically configured pair of end caps attached to respective ones of an opposed pair of ends defined by the channel member.

4. The LED light bar of claim 3 wherein each of the end caps defines an attachment tab portion adapted to facilitate the attached of the LED light bar to the support surface.

5. The LED light bar of claim 3 wherein each of the end caps defines an end wall portion having an opening formed therein which fluidly communicates with the air flow cavity.

6. The LED light bar of claim 3 wherein each of the end caps defines a base portion having a magnet disposed therein.

7. The LED light bar of claim 1 wherein the channel member is fabricated from extruded aluminum.

8. An LED light bar, comprising:

an elongate channel member defining:

an elongate support portion which defines a first surface and an opposed second surface, at least a portion of the second surface having a serrated configuration of increased surface area; and an identically configured pair of elongate rail portions integrally connected to and extending along support portion in opposed relation to the each other, each of the rail portions defining a heat sink arm segment having an exteriorly presented serrated surface and base arm segment which may be abutted against an underlying support surface;

an LED strip attached to and the channel member and extending along at least portion of the first surface of support portion thereof;

wherein the channel member is shaped such that the second surface of the support portion is separated from the base arm segments of the rail portions by a distance sufficient to facilitate the formation of a heat dissipating air flow cavity between the second surface and the support surface when the base arm segments are abutted against the support surface.

9. The LED light bar of claim 8 wherein the channel member further comprises at least one coupling arm segment which at least partially overhangs the first surface of the support portion and is operative to maintain the LED strip in engagement to the support portion.

10. The LED light bar of claim 8 further comprising a diffuser cooperatively engaged to the channel member in a manner effectively covering the LED strip.

11. The LED light bar of claim 8 further comprising an identically configured pair of elongate alignment ribs formed on and extending along the first surface of the support portion in spaced, generally parallel relation to each other, the alignment ribs being operative to assist in maintaining the LED strip in a prescribed position on the first surface of the support portion.

12. The LED light bar of claim 8 further comprising an identically configured pair of end caps attached to respective ones of an opposed pair of ends defined by the channel member.

13. The LED light bar of claim 12 wherein each of the end caps defines an attachment tab portion adapted to facilitate the attached of the LED light bar to the support surface.

14. The LED light bar of claim 12 wherein each of the end caps defines an end wall portion having an opening formed therein which fluidly communicates with the air flow cavity.

15. The LED light bar of claim 12 wherein each of the end caps defines a base portion having a magnet disposed therein.

16. The LED light bar of claim 8 wherein the channel member is fabricated from extruded aluminum.

17. An LED light bar, comprising:

an elongate channel member defining:

an elongate support portion which defines a serrated configuration of increased surface area; and an identically configured pair of elongate rail portions integrally connected to and extending along support portion in opposed relation to the each other, each of the rail portions defining an exteriorly presented serrated surface and being engageable to an underlying support surface;

an LED strip attached to and the channel member and extending along at least portion of the support portion thereof;

wherein the channel member is shaped such that the special relationship between support portion and the rail portions facilitates the formation of a heat dissipating air flow cavity between the support portion and the support surface when the rail portions are engaged to the support surface.

18. The LED light bar of claim 17 further comprising a diffuser cooperatively engaged to the channel member in a manner effectively covering the LED strip.

19. The LED light bar of claim 17 further comprising an identically configured pair of elongate alignment ribs formed on and extending along the support portion in spaced, generally parallel relation to each other, the alignment ribs being operative to assist in maintaining the LED strip in a prescribed position on the support portion.

20. The LED light bar of claim 17 further comprising an identically configured pair of end caps attached to respective ones of an opposed pair of ends defined by the channel member.

* * * * *